US009546665B2

(12) United States Patent
Stull et al.

(10) Patent No.: US 9,546,665 B2
(45) Date of Patent: Jan. 17, 2017

(54) LEVITATING CEILING FAN

(71) Applicants: Michael D. Stull, FPO, AP (US); Anthony D. Mustillo, Monroe Township, NJ (US)

(72) Inventors: Michael D. Stull, FPO, AP (US); Anthony D. Mustillo, Monroe Township, NJ (US)

( * ) Notice: Subject to any disclaimer, the term of this patent is extended or adjusted under 35 U.S.C. 154(b) by 355 days.

(21) Appl. No.: 14/172,307

(22) Filed: Feb. 4, 2014

(65) Prior Publication Data

US 2014/0271278 A1 Sep. 18, 2014

Related U.S. Application Data

(60) Provisional application No. 61/788,622, filed on Mar. 15, 2013.

(51) Int. Cl.

| | |
|---|---|
| ***F04D 29/042*** | (2006.01) |
| ***F04D 25/08*** | (2006.01) |
| ***F04D 29/60*** | (2006.01) |
| ***F04D 29/041*** | (2006.01) |
| *F04D 29/66* | (2006.01) |

(52) U.S. Cl.

CPC ..... *F04D 29/042* (2013.01); *F04D 25/088* (2013.01); *F04D 29/041* (2013.01); *F04D 29/601* (2013.01); *F04D 29/662* (2013.01)

(58) Field of Classification Search

CPC .... F04D 25/088; F04D 29/041; F04D 29/042; F04D 29/601; F04D 29/662

USPC ..... 416/246

See application file for complete search history.

(56) References Cited

U.S. PATENT DOCUMENTS

| | | | | |
|---|---|---|---|---|
| 5,256,037 | A * | 10/1993 | Chatelain | F04D 29/662 310/51 |
| 5,593,281 | A * | 1/1997 | Tai | F04D 25/088 416/145 |
| 5,856,719 | A * | 1/1999 | De Armas | H02K 49/06 310/103 |
| 2002/0085919 | A1* | 7/2002 | Ross | F04D 29/601 416/246 |
| 2003/0202882 | A1* | 10/2003 | Tang | F04D 25/088 416/246 |
| 2008/0037264 | A1* | 2/2008 | Bennett | F04D 25/088 362/386 |
| 2009/0263254 | A1* | 10/2009 | Bucher | F04D 25/088 416/229 R |

FOREIGN PATENT DOCUMENTS

CN 201416554 Y * 3/2010

OTHER PUBLICATIONS

English machine translation of CN 201416554.*

* cited by examiner

*Primary Examiner* — Dominick L Plakkoottam
(74) *Attorney, Agent, or Firm* — Kim Winston LLP

(57) ABSTRACT

A ceiling fan including a motor with a stator and a rotor, a downrod assembly having a longitudinal slot therein and a base portion, and a plurality of fan blades attached to the rotor. The motor is capable of sliding along the downrod assembly in order to change the position along the downrod assembly that the plurality of fan blades rotate. Additionally, the speed at which the plurality of fan blades rotate corresponds to the height above the base portion that the plurality of fan blades elevate.

14 Claims, 4 Drawing Sheets

LEVITATING CEILING FAN

CROSS-REFERENCE TO RELATED APPLICATIONS

This application claims the benefit of U.S. Provisional Application No. 61/788,622, filed Mar. 15, 2013, the entire contents of which are incorporated herein by reference in their entirety for all purposes.

TECHNICAL FIELD

This disclosure relates generally to the field of ceiling fans and, in particular, ceiling fans that can elevate or slide along a ceiling downrod.

BACKGROUND

Ceiling fans are a very common way for people to cool a room. Current ceiling fans typically mount directly adjacent to a ceiling (direct mount) or are mounted to the ceiling by way of a downrod, which allows the ceiling fan to hang down from the ceiling a certain distance, for example, 6 in., 1 ft., 2 ft., 3 ft., 4 ft., etc. In both cases, whether directly mounted to the ceiling or mounted by way of a downrod, the position or height of the ceiling fan above the floor remains fixed.

In addition, current ceiling fans typically have hub mounted ceiling fan blades that directly connect to an electric motor. The blades are powered by a direct current (DC) electric motor that converts electrical energy into mechanical energy. This conversion of electrical energy into mechanical energy causes the ceiling fan to rotate.

Embodiments of the present invention disclosed and described herein are directed to a new type of ceiling fan that can move up and down a ceiling downrod or whose position on the ceiling downrod can be adjusted.

SUMMARY

An embodiment of the present invention is directed to an elevating ceiling fan comprising a downrod assembly having a base and a plurality of first magnetic devices. The ceiling fan also includes a rotor having a plurality of second magnetic devices and a plurality of fan blades attached to the rotor. The plurality of first magnetic devices are capable of alternating polarity in order to induce rotation of the rotor and the plurality of fan blades. In addition, rotation of the rotor and the plurality of fan blades causes the rotor and the plurality of fan blades to elevate above the base of the downrod assembly.

Another embodiment of the present invention is directed to a ceiling fan comprising a motor having a stator and a rotor with a plurality of fan blades attached to the rotor. The ceiling fan also includes a downrod assembly having a longitudinal slot therein and a base portion. In this embodiment, the motor is capable of sliding along the downrod assembly in order to change the position along the downrod assembly that the plurality of fan blades rotate.

A further embodiment of the present invention is directed to a ceiling fan having a rotor with a plurality of fan blades attached thereto. The ceiling fan also includes a means for rotating the rotor and a downrod assembly having a bottom end. In this embodiment, the rotor is capable of sliding along a length of the downrod assembly.

The various features of novelty that characterize the embodiments of the present invention are pointed out in particularity in the claims annexed to and forming a part of this disclosure. For a better understanding of the invention, its operating advantages and specific objects attained by its uses, reference is made to the accompanying descriptive matter in which preferred embodiments of the invention are illustrated in the accompanying drawings.

DETAILED DESCRIPTION

Figure 1:
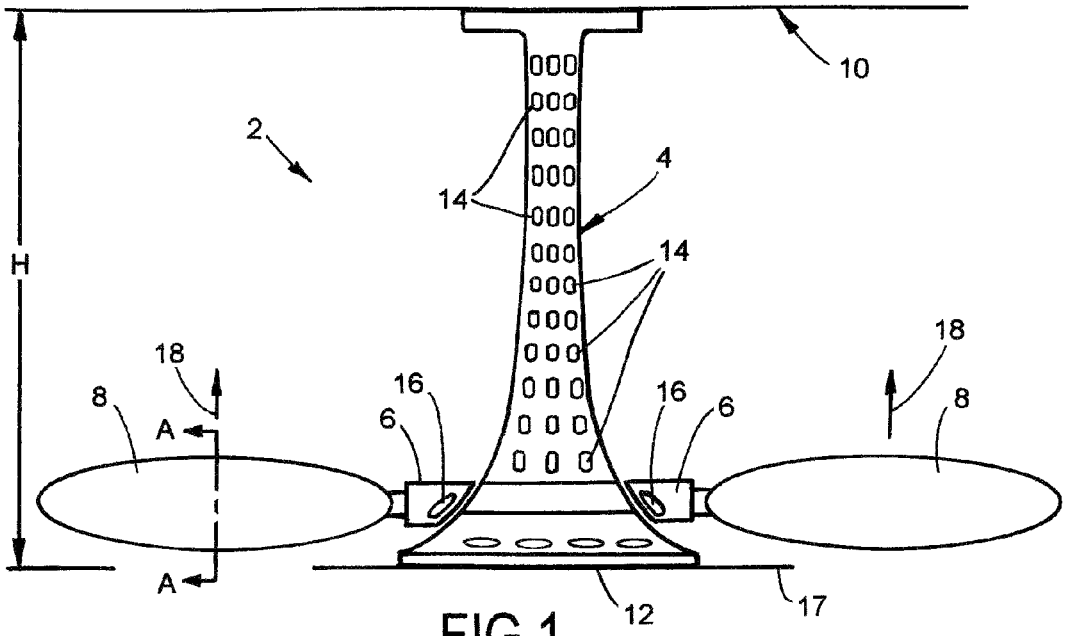
FIG. 1 is a side elevation view of a ceiling fan, according to an embodiment of the present invention.
Figure 2:
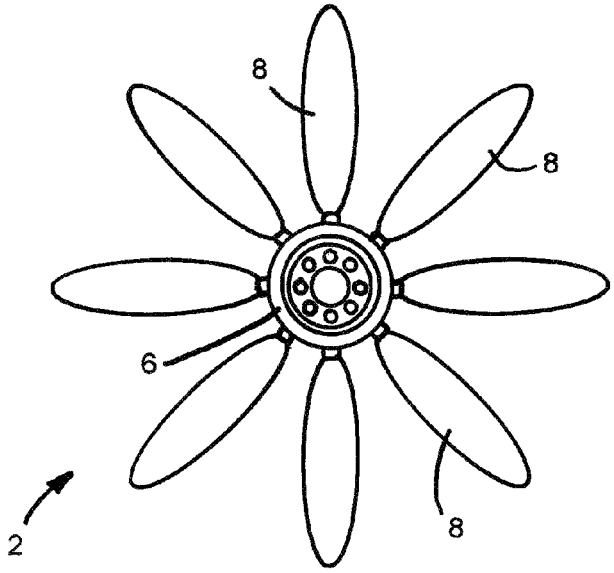
FIG. 2 is a bottom plan view of a ceiling fan according to an embodiment of the present invention.

Embodiments of the present invention are described more fully hereinafter with reference to the accompanying drawings. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art. Elements that are identified using the same or similar reference characters refer to the same or similar elements. Features disclosed as belonging to certain embodiments can be used with other embodiments of the invention disclosed herein.

It is to be understood that this invention is not limited to the specific devices, methods, conditions, or parameters described and/or shown herein, and that the terminology used herein is for the purpose of describing particular embodiments by way of example only. Thus, the terminology is intended to be broadly construed and is not intended to be limiting of the disclosed invention. For example, as used in the specification including the appended numbered paragraphs, the singular forms "a," "an," and "one" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein. And any dimensions shown in the attached drawings are representative and not limiting of the invention, as larger or smaller dimensions can be used as desired.

It will also be understood that, although the terms first, second, etc. may be used herein to describe various elements, these elements should not be limited by these terms. These terms are only used to distinguish one element from another. Thus, a first element could be termed a second element without departing from the teachings of the embodiments of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Embodiments of the present invention are directed to a ceiling fan that converts electric energy into magnetic energy and uses this magnetic energy to induce rotation of a ceiling fan rotor. Because the rotor is not directly mounted to the downrod, the rotor and hence, the attached fan blades can elevate or levitate as the blades rotate.

Depicted in FIG. 1 is an embodiment of the present invention. The ceiling fan 2 includes a downrod assembly 4, a rotor 6 and a plurality of fan blades 8. The number of fan blades 8 can be 2, 3, 4, 5, 6, 7, 8, and more than 8. As can be seen in FIG. 1, the downrod assembly 4 mounts to a ceiling 10 thereby suspending the base 12 of the downrod assembly and hence, the rotor 6, a distance "H" from the ceiling. Included along the length of the downrod assembly 4 are a plurality of powered magnetic devices or electromagnetic devices 14 that are arranged in vertical rows (they need not be arranged in rows). Included within the circumference of the rotor are a plurality of magnets or magnetic devices 16.

Figure 3:
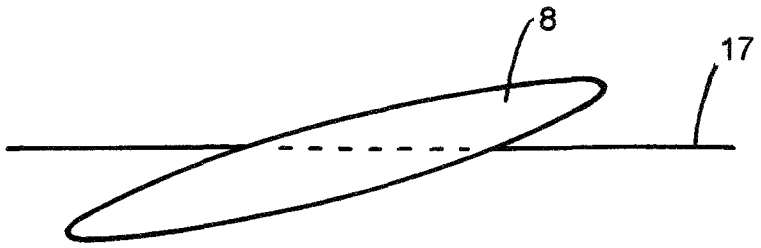
FIG. 3 is a side perspective view of a fan blade, according to an embodiment of the present invention.
Figure 4:
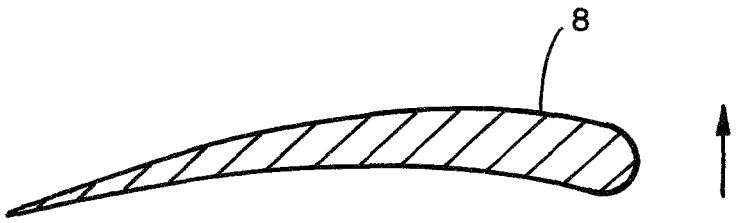
FIG. 4 depicts cross-section A-A identified in FIG. 1.

The blades 8 are mounted to the rotor 6 in such a manner that as they rotate, they generate lift. Such mounting can include the blades mounted at an angle relative to a horizontal plane 17 through the base 12 of the downrod assembly 4 (see FIG. 3) or, as depicted in FIG. 4, the blades 8 can have a cross-sectional shape in the form of an airfoil similar to an airplane's wing or a propeller such that as the rotor 6 rotates the blades 8, an area of low pressure is created above the blades 8 and an area of high pressure is created below the blades 8, causing the blades 8 to generate lift. As a result of this lift, the blades 8 and rotor 6 "fly up" the downrod assembly 4 or elevate or levitate above the base 12 of the downrod assembly 4 in the direction of arrows 18.

Rotation of the rotor 6 and fan blades 8 is induced by the magnetic forces created by the powered magnetic devices 14 included on the downrod assembly 4. Electrical energy is converted to magnetic energy by the powered magnetic devices 14 in such a way that the polarity of the powered magnetic devices 14 alternates. This alternating polarity of the powered magnetic devices 14 is received by the magnetic devices 16 on the rotor 6. The alternating polarity of the powered magnetic devices 14 of the downrod assembly 4 induces rotation of the rotor 6 and hence the fan blades 8 attached thereto. As previously disclosed, this rotation of the fan blades 8 causes the rotor 6 and fan blades 8 to "fly up" the downrod assembly 4.

The height that the rotor 6 and fan blades 8 fly up the downrod assembly 4 (or elevate above the base 12) can be controlled by (1) the rotation speed of the rotor 6 and fan blades 8 (the faster they rotate, the more lift is generated causing the rotor 6 and fan blades 8 to fly higher up the downrod assembly 4 above the base 12, or (2) the number of rows of powered magnetic devices 14 on the downrod assembly 4 that are activated—the more rows of powered magnetic devices 14 that are activated, the higher up the downrod assembly 4 the rotating rotor 6 and fan blades 8 climb (that is, if only half the vertical rows of powered magnetic devices 14 on the downrod assembly 4 are activated, then the rotor 6 and fan blades 8 will only climb halfway up the downrod assembly 4 toward the ceiling 10). It should be noted that the height above the base 12 that the rotating rotor 6 and fan blades 8 elevates can be controlled individually by the above-two disclosed principles or through a combination of both principles.

The speed at which the rotor 6 and fan blades 8 rotate can be adjusted by adjusting the rate at which the polarity of the powered magnetic devices 14 alternates. Thus, a variable controller may be used to control the rate at which the polarity of the powered magnetic devices 14 alternates thereby controlling the speed at which the rotor 6 and fan blades 8 rotate. The variable controller may also be used to control the number of lines of powered magnetic devices 14 and hence, the number of powered magnetic devices 14 activated.

Thus, because the height H from the ceiling 10 (which corresponds to the height of the fan blades 8 above the floor) that the fan blades 8 rotate is adjustable, a user can control the degree or amount of cooling or heating in a room. That is, the closer to the ceiling 10 that the fan blades 8 rotate, the wider or larger the area of the room that can be cooled or heated.

Figure 5:
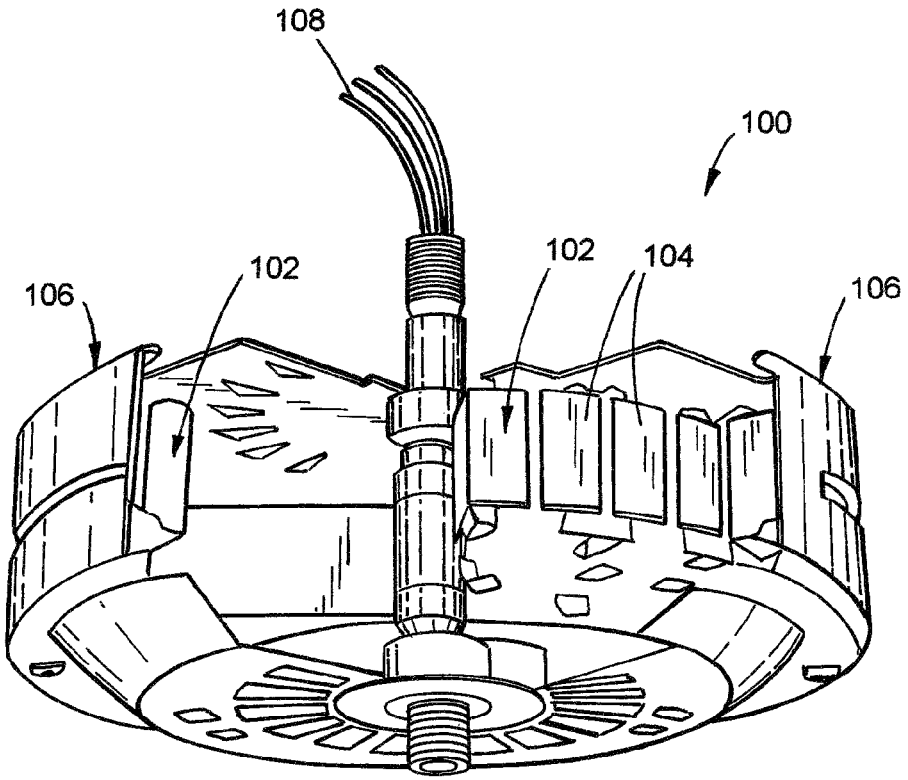
FIG. 5 is a partial, cut-away perspective view of an induction motor, according to an embodiment of the present invention.
Figure 6:
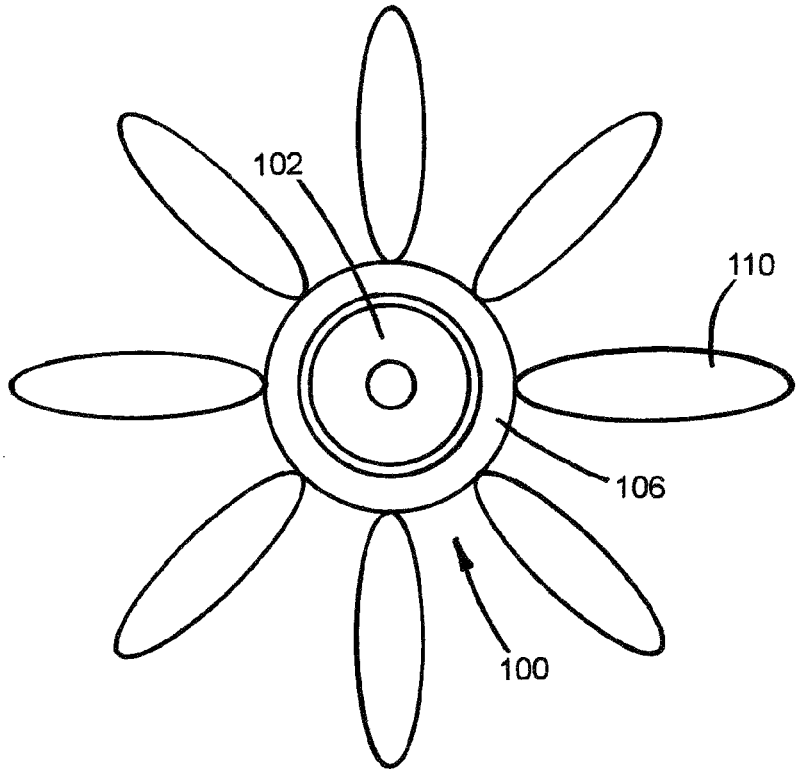
FIG. 6 is a bottom plan view of a ceiling fan according to an embodiment of the present invention.

In other embodiments of the present invention, a conventional induction motor can be used to power the ceiling fan. In these embodiments, as depicted in FIGS. 5 and 6, the induction motor 100 includes a central, non-rotating stator 102 having a plurality of electromagnets 104 thereon that are designed to produce a rotating magnetic field. The induction motor 100 also includes a rotor 106 that surrounds the stator 102. In operation, power is delivered through electrical wires 108 to the electromagnets 104 of the stator 102. In response, the electromagnets 104 are energized around the circumference of the stator 102 creating a magnetic field that rotates around the stator 102. This rotating magnetic field causes the rotor 106 to rotate or spin in a corresponding manner, which causes the plurality of fan blades 110 attached to the rotor 106 to also rotate or spin. Those skilled in the art readily understand how a conventional induction motor used for a ceiling fan operates to rotate the blades of the ceiling fan. Those skilled in the art will also readily understand that in alternate embodiments, the induction motor 100 can include a central, rotating rotor and a non-rotating stator having a plurality of electromagnets thereon that are designed to produce a rotating magnetic field where the stator surrounds the rotor.

Figure 7:
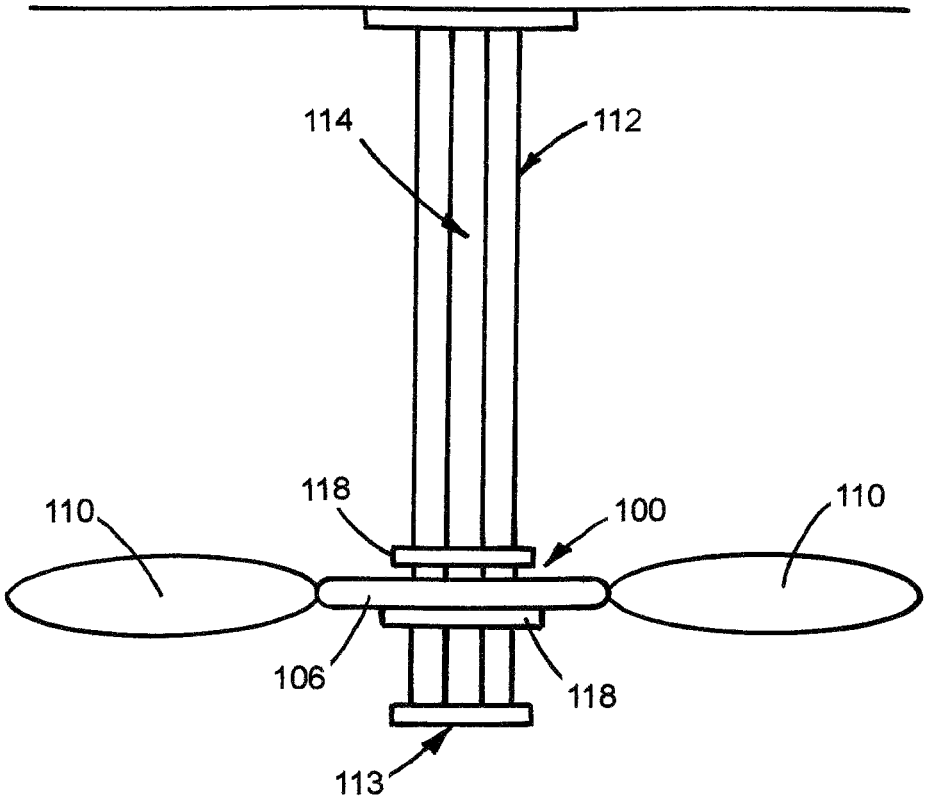
FIG. 7 is a side elevation view of a ceiling fan, according to an embodiment of the present invention.
Figure 8:
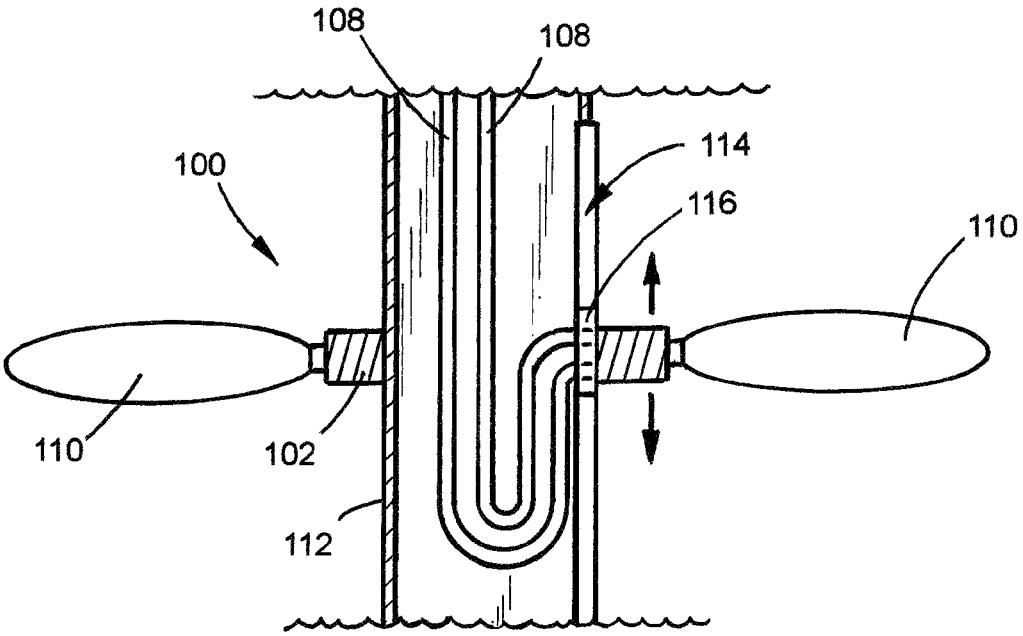
FIG. 8 is a partial cross-sectional view of a downrod assembly, according to an embodiment of the present invention.

As depicted in FIG. 7, the downrod assembly 112 can include a base portion 113 and a vertical slot 114 along its length. This vertical slot 114 allows the induction motor 100 to connect to the electrical wires 108 and the downrod assembly 112 in such a manner that permits the plurality of fan blades 110 to "fly up" the downrod assembly 112. That is, the induction motor 100 is not rigidly attached to the base portion or bottom end 113 of the downrod assembly 112. Instead, the induction motor 100 attaches to the downrod assembly 112 in a manner that allows it and the attached plurality of fan blades 110, to slide along the length of the downrod assembly 112, i.e., move up and down the downrod assembly 112, as the plurality of fan blades 110 rotate. In these embodiments, as best seen in FIG. 8, the electrical wires 108 attach to the stator 102 through the vertical slot 114 such that as the induction motor 100 moves up and down the downrod assembly 112 as a result of the rotating fan blades 110, the electrical wires 108 move within this vertical slot 114 while still being attached to the stator 102.

In order to keep the electrical wires 108 on the interior of the downrod assembly 112, the vertical slot 114 can include a rubber insert containing a longitudinal slit, which allows either a portion of the electrical wires 108 to protrude through or a portion of the stator 102 to protrude through into the interior of the downrod assembly 112 thereby permitting the stator 102 and hence, the induction motor 100, to move up and down the downrod assembly 112 in an unimpeded manner.

In addition, the vertical slot 114 can include a sliding structure 116 that is received within the vertical edges of the vertical slot 114 such that the vertical slot 114 acts as a track that permits the sliding structure 116 to slide along the vertical slot 114. The sliding structure 116 can receive either the ends of the electrical wires 108 or the portion of the stator 102 that the electrical wires 108 connect to. In this configuration, the sliding structure 116 slides up and down the downrod assembly 112 with the induction motor 100 and fan blades 110 as the fan blades 110 rotate while maintaining the electrical wires 108 on the interior of the downrod assembly 112 and allowing the electrical wires 108 to move in a corresponding manner on the interior of the downrod assembly 112.

Similar to the previously disclosed embodiment, the speed at which the rotor 106 and fan blades 110 rotate can be adjusted by using a variable controller that controls how fast the rotating magnetic field rotates. The speed at which the fan blades 110 rotate correlates to how high up the downrod assembly 112 the induction motor 100 and hence, the fan blades 110 "fly."

Furthermore, in certain embodiments, the downrod assembly 112 can include adjustable collars 118 (see FIG. 7) that permit a user to selectively change and set the position of the rotating fan blades 110 on the downrod assembly 112 and hence the height above the floor that the fan blades 110 rotate. One or two adjustable collars 118 may be used. Thus, with this type of downrod assembly, a user has the ability to adjust or vary the height that the fan blades rotate above the floor with the installation of only a single downrod assembly.

Embodiments of the present invention can be made from the same materials used to make conventional ceiling fans.

Although the embodiments of the present invention have been described above in terms of exemplary embodiments, it is not limited thereto. Rather, the appended numbered paragraphs should be construed broadly to include other variants and embodiments of the invention which may be made by those skilled in the art without departing from the scope and range of equivalents of the invention.

We claim:

1. A ceiling fan comprising:

a motor having a stator and a rotor;

a downrod assembly having a longitudinal slot therein and a base portion; and a plurality of fan blades attached to the rotor, wherein the motor is capable of sliding along the downrod assembly in order to change a position along the downrod assembly that the plurality of fan blades rotate, and wherein a speed at which the plurality of fan blades rotate corresponds to a height above the base portion that the plurality of fan blades elevate.

2. The ceiling fan of claim 1, wherein each of the plurality of fan blades has a cross-sectional shape in the form of an airfoil.

3. The ceiling fan of claim 1, wherein the plurality of fan blades attach to the rotor at an angle with respect to a horizontal plane through the base portion of the downrod assembly.

4. The ceiling fan of claim 1, wherein the longitudinal slot includes a sliding structure.

5. The ceiling fan of claim 4, wherein the sliding structure receives electrical wires for connection to the motor.

6. The ceiling fan of claim 4, wherein the sliding structure is capable of sliding within the longitudinal slot.

7. The ceiling fan of claim 1, further comprising at least one collar for setting the position of the plurality of fan blades on the downrod assembly.

8. A ceiling fan comprising:

a rotor having a plurality of fan blades attached thereto;

a means for rotating the rotor; and a downrod assembly having a bottom end, wherein the rotor is capable of sliding along a length of the downrod assembly, and wherein a speed at which the plurality of fan blades rotate corresponds to a height above the bottom end of the downrod assembly that the plurality of fan blades elevate.

9. The ceiling fan of claim 8, wherein each of the plurality of fan blades has a cross-sectional shape in the form of an airfoil.

10. The ceiling fan of claim 8, wherein the plurality of fan blades attach to the rotor at an angle with respect to a horizontal plane through the bottom end of the downrod assembly.

11. The ceiling fan of claim 8, wherein the downrod assembly includes a longitudinal slot.

12. The ceiling fan of claim 11, wherein the longitudinal slot includes a sliding structure.

13. The ceiling fan of claim 12, wherein the sliding structure is capable of sliding along the longitudinal slot.

14. The ceiling fan of claim 8, further comprising at least one collar for setting the position of the plurality of fan blades on the downrod assembly.

* * * * *